US007467960B1

(12) United States Patent
Harlan et al.

(10) Patent No.: US 7,467,960 B1
(45) Date of Patent: Dec. 23, 2008

(54) RECEPTACLE CONNECTOR WITH ARCING REDUCING STRUCTURE

(75) Inventors: Tod M. Harlan, Mechanicsburg, PA (US); Terrance F. Little, York, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/880,574

(22) Filed: Jul. 23, 2007

(51) Int. Cl.
*H01R 13/53* (2006.01)

(52) U.S. Cl. ..... 439/181; 439/934; 439/693

(58) Field of Classification Search ..... 439/181, 439/934, 693
See application file for complete search history.

(56) References Cited

U.S. PATENT DOCUMENTS 4,747,783 A * 5/1988 Bellamy et al. ..... 439/59
6,537,091 B2 * 3/2003 Hirai et al. ..... 439/181
6,623,288 B2 * 9/2003 Sakiyama et al. ..... 439/181
6,857,887 B1 * 2/2005 Belson et al. ..... 439/181
6,860,746 B2 * 3/2005 Ota et al. ..... 439/181
2002/0064986 A1 * 5/2002 Hirai et al. ..... 439/181
2003/0176093 A1 * 9/2003 Ota et al. ..... 439/181
2003/0194893 A1 * 10/2003 Ota et al. ..... 439/181
2004/0137721 A1 * 7/2004 Lim et al. ..... 438/638

* cited by examiner

*Primary Examiner*—Gary F. Paumen
(74) *Attorney, Agent, or Firm*—Wei Te Chung

(57) ABSTRACT

The present invention provides a receptacle (100) having structures for reducing arcing when a plug (300) is drawn out of the receptacle (100). The receptacle (100) includes a number of electrical contacts (20), each of the electrical contacts (20) being slidably mating with a corresponding conductive terminal (34) of the plug (300) and therefore defining a mating area on the electrical contact (20). Each of the electrical contacts (20) includes a conductive area (222) to abut the corresponding terminal when the plug (300) are fully mated in the receptacle (100) and a less conductive area (224) where the conductive terminal (34) slides thereto and then leave the electrical contact (20) therefrom when the plug (300) is being drawn out of the receptacle (100).

9 Claims, 12 Drawing Sheets

RECEPTACLE CONNECTOR WITH ARCING REDUCING STRUCTURE

BACKGROUND OF THE INVENTION

1. Field of the Invention

The present invention relates to a receptacle connector for mating with an insertable plug, and more particularly, relates to a receptacle having structures for reducing arcing when the plug is drawn out of the receptacle.

2. Description of the Prior Art

A new type of electrical connector, PoE connector, is introduced in the recent years. The connector is used for transmitting Power over Ethernet, therefore, at least a pair of electrical contacts mounted in the connector is used for transmitting power. Referring to FIGS. 1 and 2, when a mated plug 900 is drawn out from the PoE connector 800, arcing may generate between the pair of electrical contacts 80 of the PoE connector 800 and corresponding terminals 90 of the mating plug 900, which creates a spark crater in the plug terminals.

BRIEF SUMMARY OF THE INVENTION

Therefore, one object of the present invention is to provide an electrical connector the contacts of which have structures for reducing the arcing between the electrical connector and a mating plug when the mating plug is being withdrawn therefrom.

A receptacle connector with arcing reducing structure is provided in the present invention. The receptacle connector comprises an insulative housing defining an opening for receiving a mating plug having a plurality of conductive terminals, and a plurality of electrical contacts disposed in said opening to slidably engage said conductive terminals of said mating plug, respectively. At least one of the electrical contacts defines a conductive area and a less conductive area adjacent to said conductive area. When the plug is mated in the opening, the corresponding conductive terminal abuts said conductive area, and when the plug is being withdrawn from the opening, the conductive terminal translates away from the conductive area to the less conductive area and then disengages the electrical contact therefrom.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
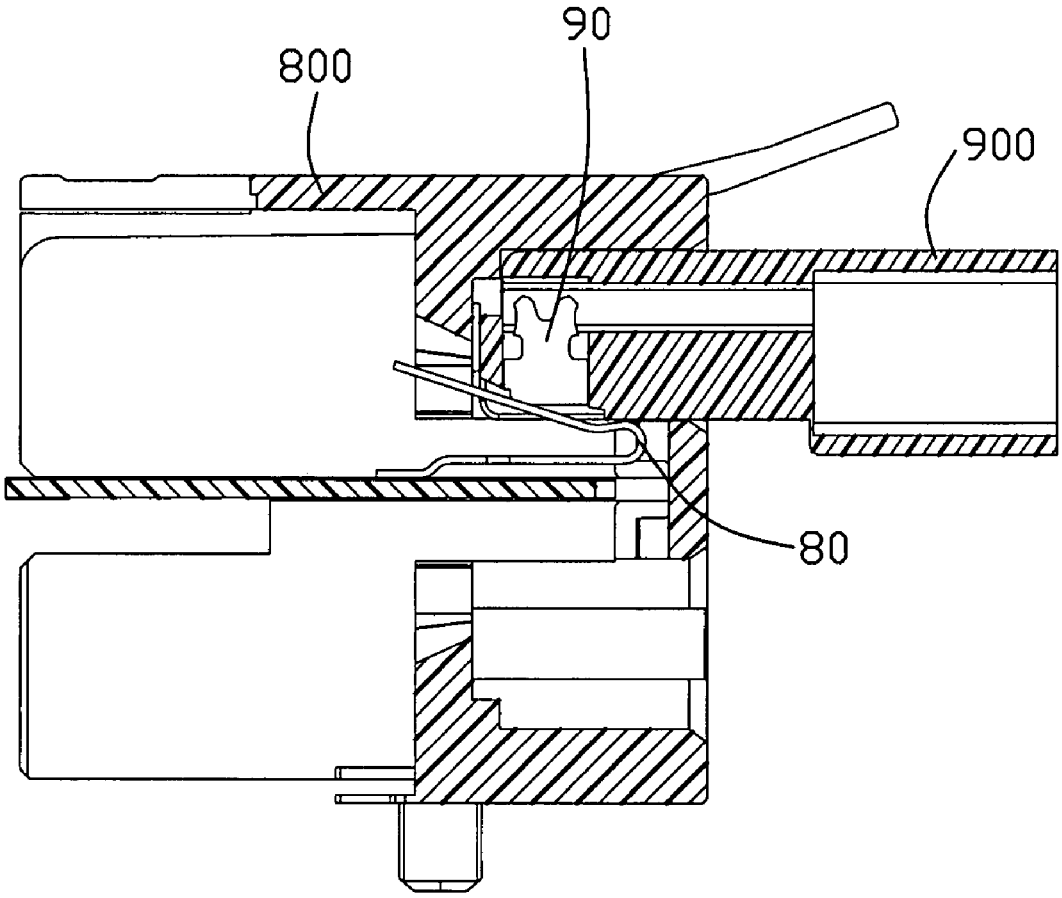
FIG. 1 (PRIOR ART)
FIG. 1 is a cutaway view of a prior connector with a mating plug in a fully mated position (some modules of the prior connector and cable connecting the mating plug have been omitted)
Figure 2:
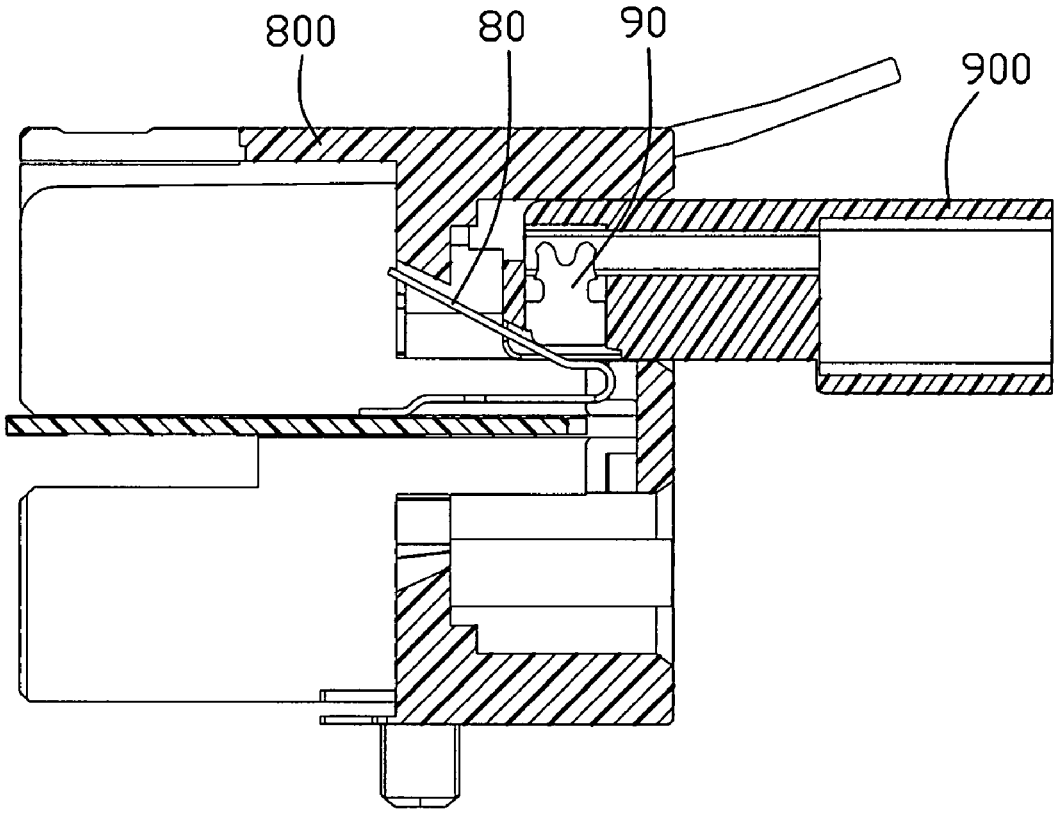
FIG. 2 (PRIOR ART)
FIG. 2 is a cutaway view similar to FIG. 1, except that the mating plug is partially withdrawn to the separation point from the receptacle and arcing may generate at this time and position.
Figure 3:
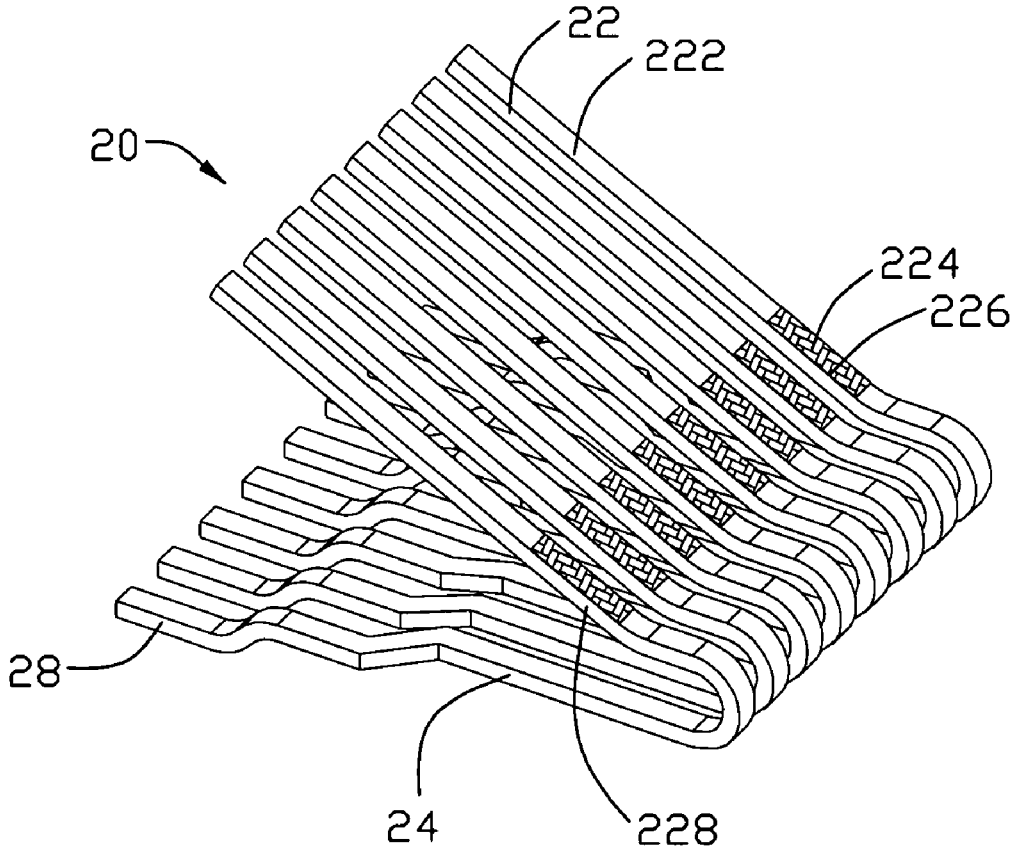
FIG. 3 is a perspective view showing a plurality of electrical contacts according to a first embodiment of the present invention.

Reference will now be made to the drawing figures to describe the present invention in detail.

FIGS. 3-7 show a connector assembly according to a first embodiment of the present invention. The connector assembly includes a 2XN-port RJ 45 receptacle connector 100 and a mating electrical plug 300.

The receptacle connector 100 includes an insulative housing 10 and a number of contact modules received in the insulative housing 10. The insulative housing 10 defines a front face 12 and 2XN openings 14 in the front face 12. Each of contact modules has an internal PCB (not labeled), a number of electrical contacts 20 mounted on the internal PCB, power modules (not shown) electrically connecting to some of the electrical contacts 20 and transferring modules (not shown) electrically connecting the internal PCB to a mother PCB. Each of the electrical contacts includes a contacting portion 22 slantwise extending into one of the openings 14, a soldering portion 28 extending out of the insulative housing 10, and a connecting portion 24 connecting the contacting portion 22 and the soldering portion 28. The contacting portion 22 further defines a conductive area 222 and an area 224 less conductive than the area 222 and facing the front face 12. The less conductive area 224 is formed through applying a layer 226 of low conductive material, such as polymer, ceramic, etc, on a conductive base 228.

The mating plug 300 includes a transparent housing 32 and a corresponding number of terminals 34 to respectively mate with the electrical contacts 20 of receptacle connector 100.

Figure 4:
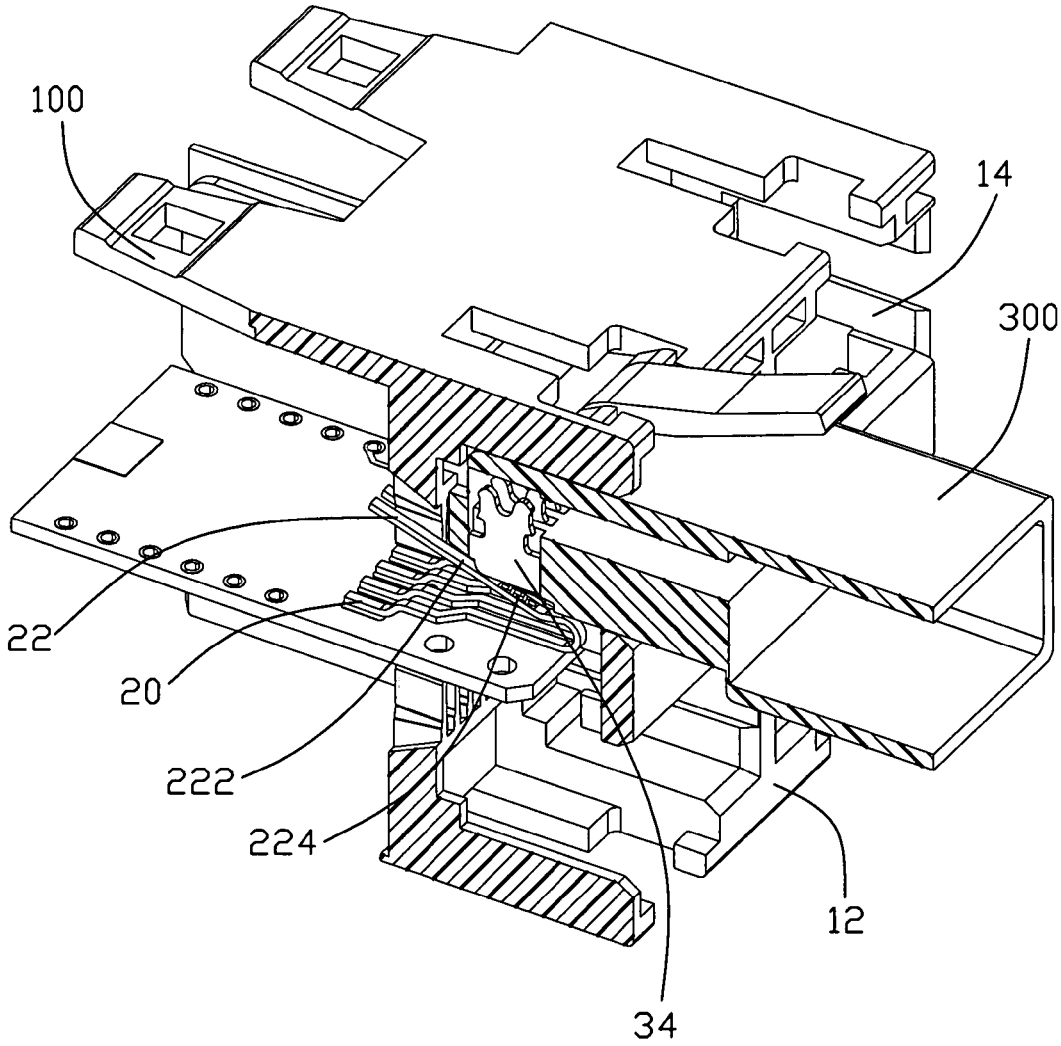
FIG. 4 is a cutaway view of an electrical receptacle according to the first embodiment of the present invention, with the mating plug in a fully mated position (some modules of the electrical receptacle and cable connecting the mating plug have been omitted)
Figure 5:
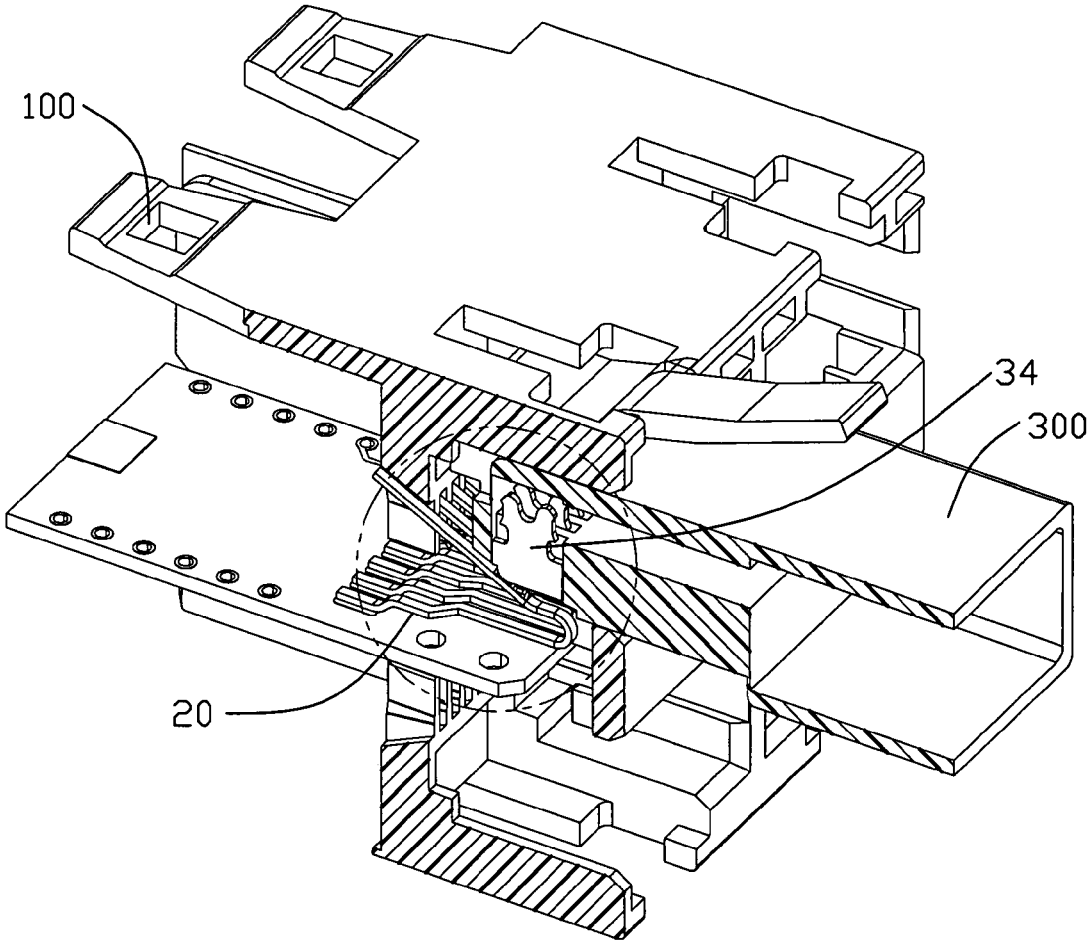
FIG. 5 is a cutaway view similar to FIG. 4, except that the plug is partially drawn out of the electrical receptacle.
Figure 6:
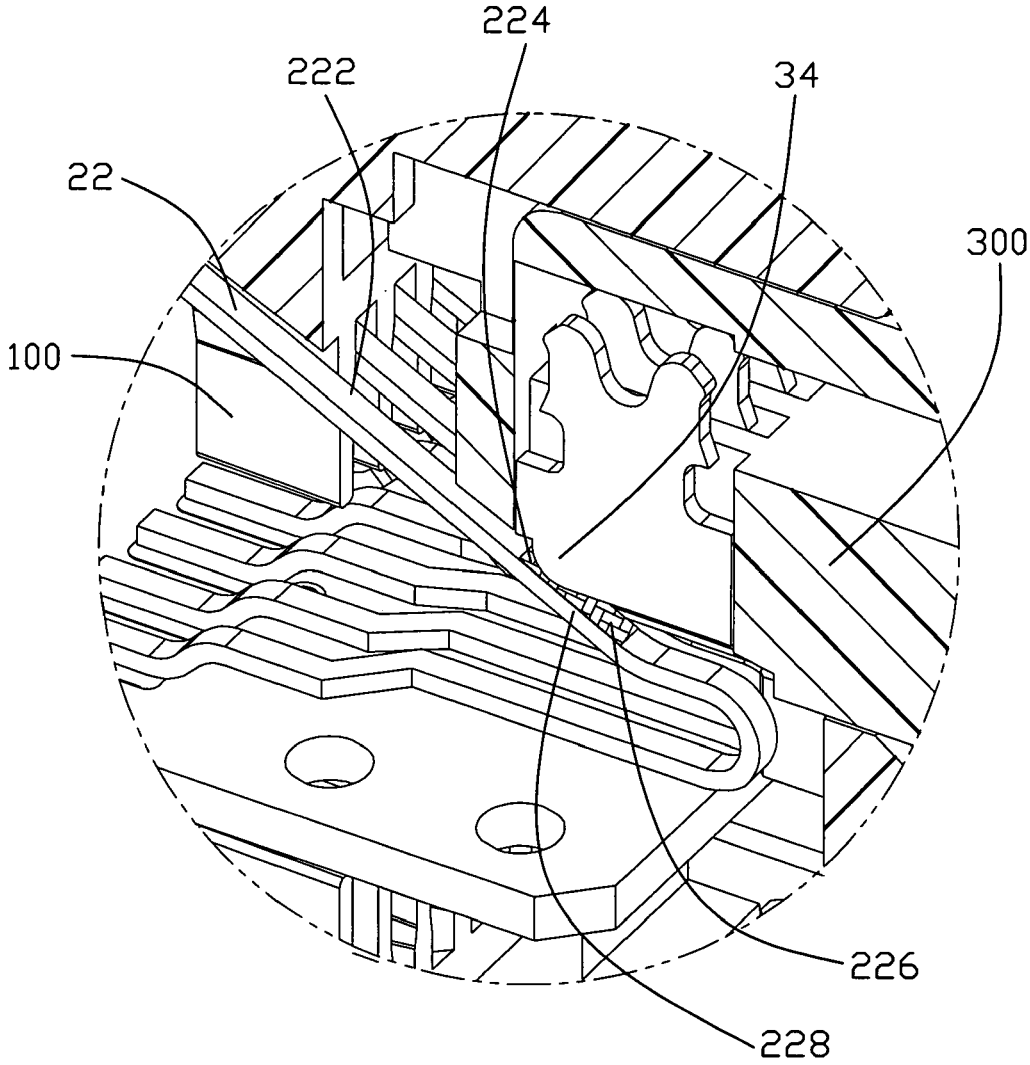
FIG. 6 is a scaled view of a circled portion of FIG. 5.
Figure 7:
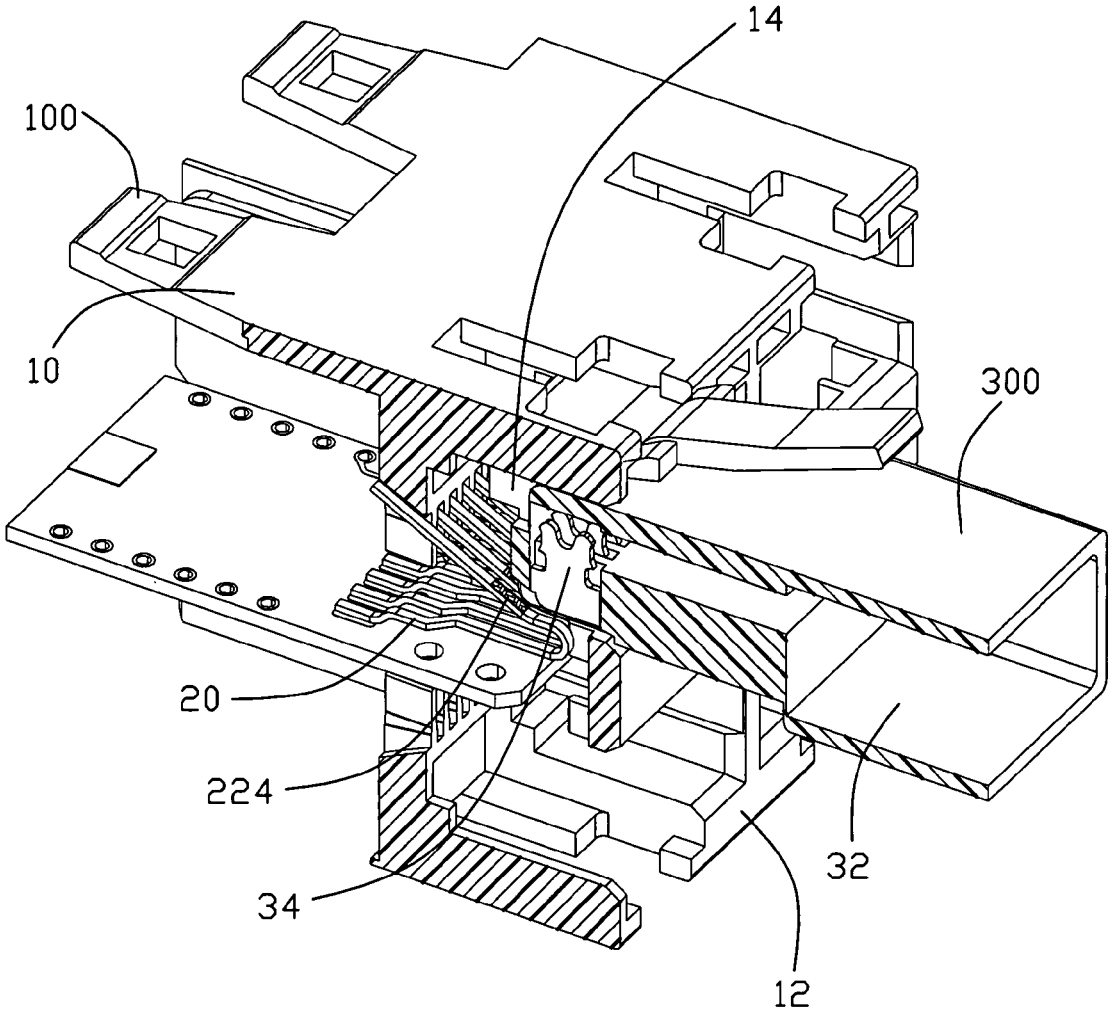
FIG. 7 is a cutaway view similar to FIG. 5, except that the plug is further drawn out of the electrical receptacle.

As shown in FIG. 4, when the mating plug 300 is fully mated in the electrical receptacle 100, the terminals 34 of the mating plug 300 deflect the electrical contacts 20 of the electrical receptacle 100 and abut the conductive areas 222, thereby forming electrical connections therebetween. Referring to FIGS. 5 and 6, when the mating plug 300 is being withdrawn therefrom, the locations where the terminals 34 abut the electrical contacts translate from the conductive areas 222 to the less conductive areas 224, so that a transition occurs. Referring to FIG. 7, when the mating plug 300 is further withdrawn out of the electrical receptacle 100, the terminals 34 of the mating plug 300 disengage the electrical contacts 20 of the receptacle 100.

Figure 8:
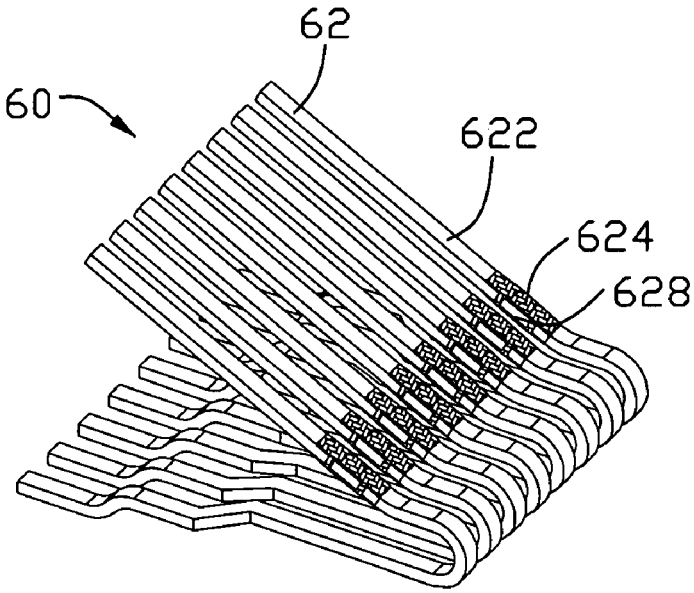
FIG. 8 is a perspective view showing a plurality of electrical contacts according to a second embodiment of the present invention.
Figure 9:
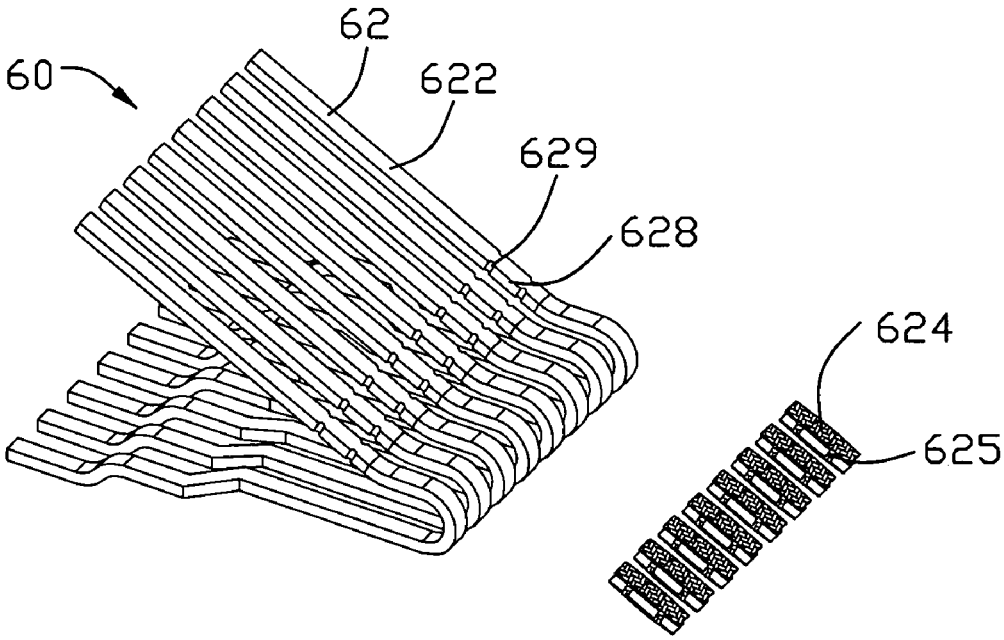
FIG. 9 is an exploded view of the contacts shown in FIG. 8.
Figure 10:
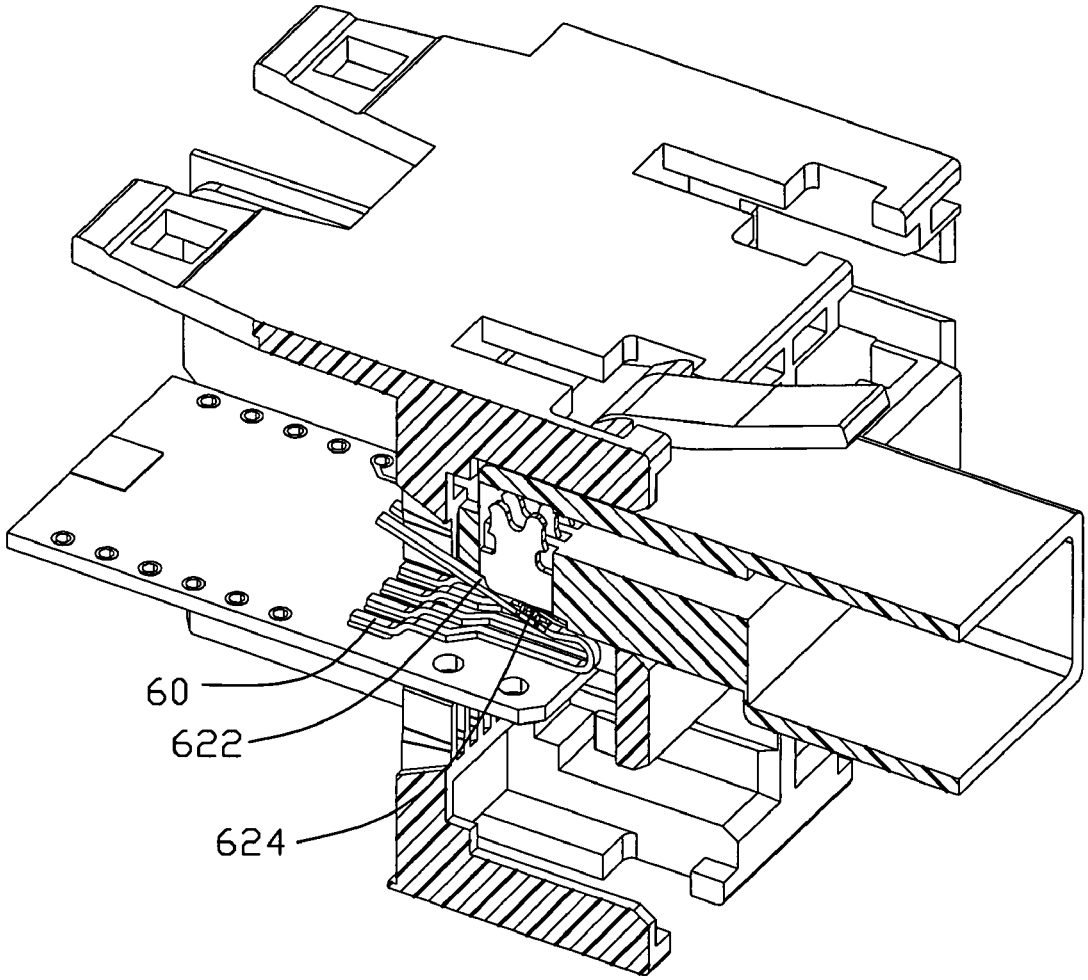
FIG. 10 is a cutaway view of an electrical receptacle according to the second embodiment of the present invention, with the mating plug in a fully mated position.
Figure 11:
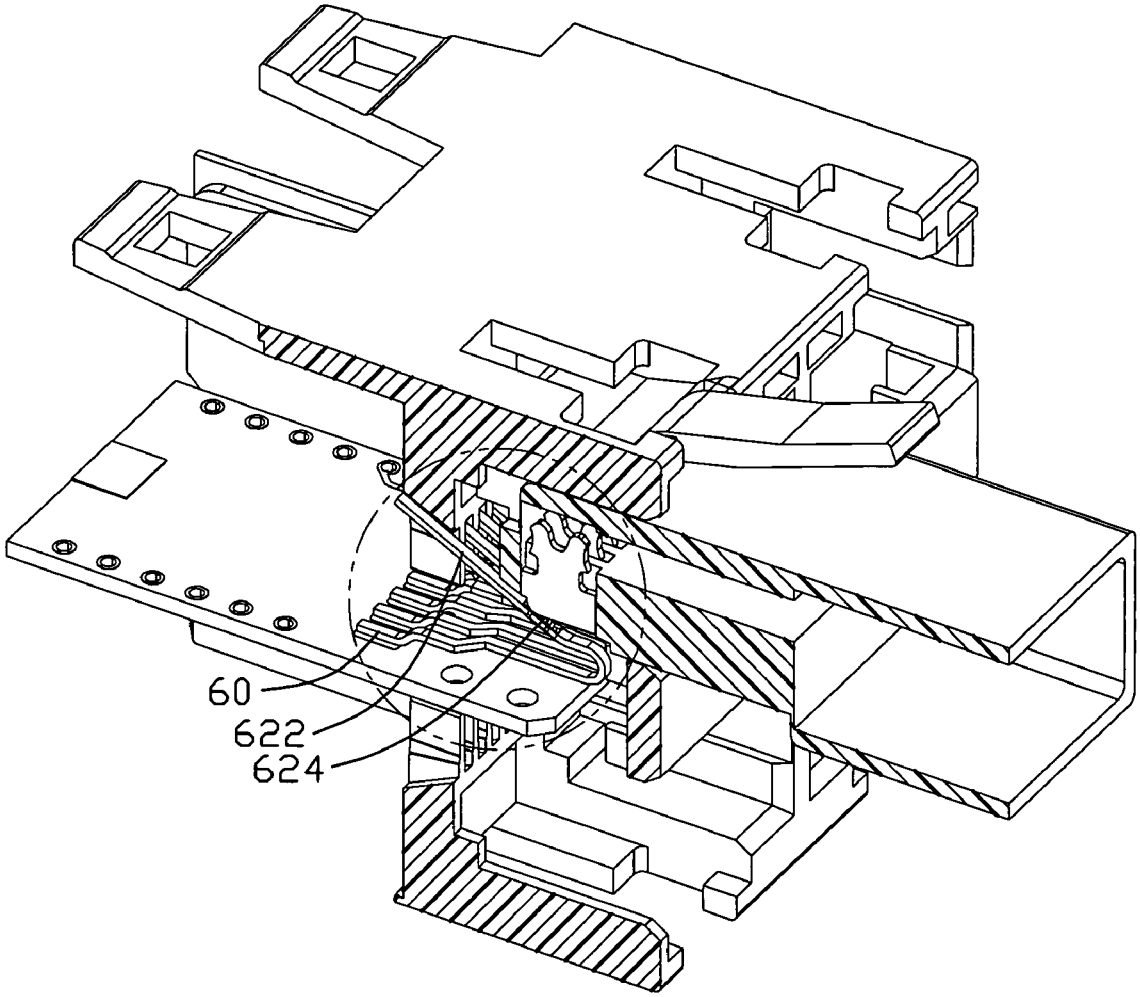
FIG. 11 is a cutaway view similar to FIG. 10, except that the plug is partially drawn out of the electrical receptacle.
Figure 12:
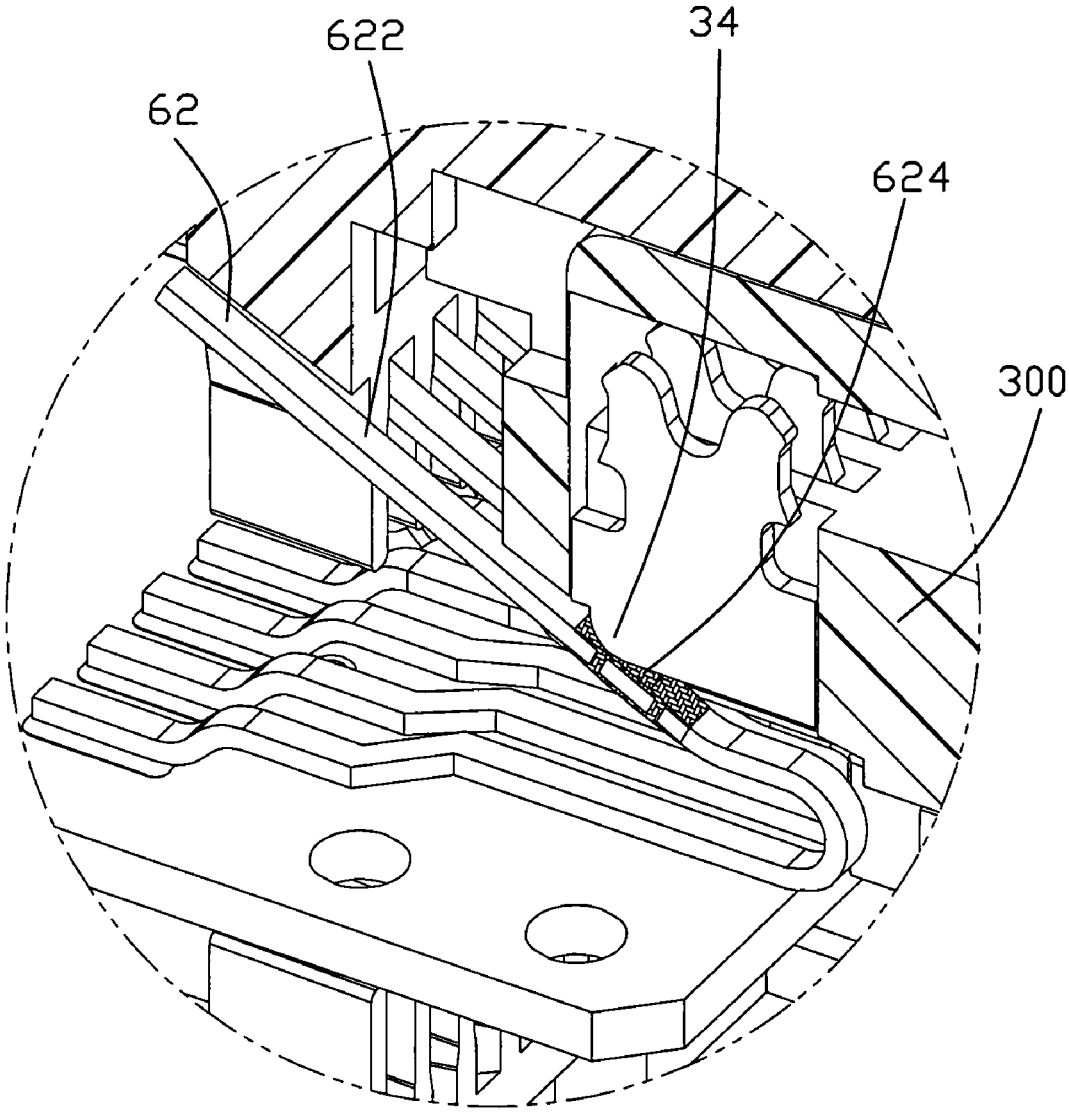
FIG. 12 is a scaled view of a circled portion of FIG. 11.
Figure 13:
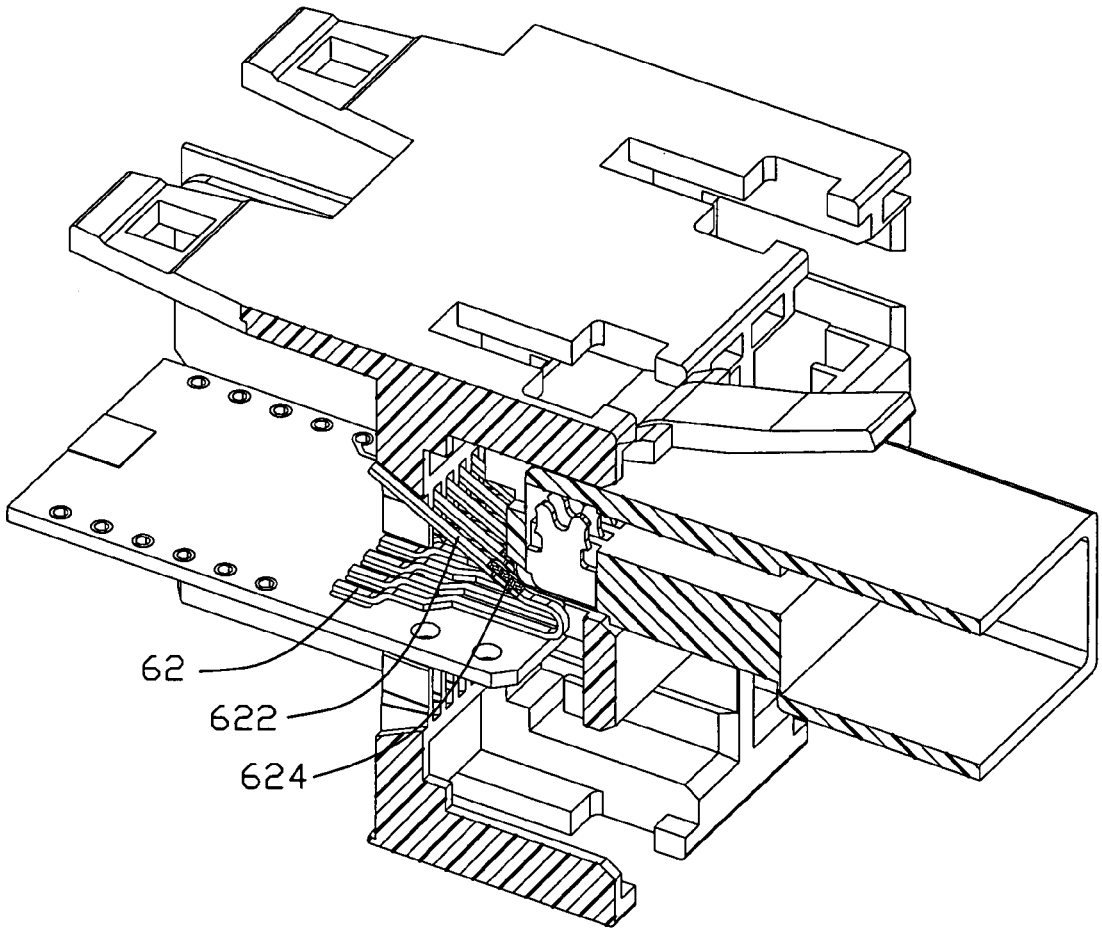
FIG. 13 is a cutaway view similar to FIG. 5, except that the plug is further drawn out of the electrical receptacle.

FIG. 8 discloses a plurality of electrical contacts 60 according to a second embodiment of the present invention. Similar to the first embodiment, each of the electrical contacts 60 has a contacting portion 62 forming a conductive area 622 and a less conductive area 624 adjacent to the conductive area 622, the less conductive area 624 defined by a low conductive material 625 adhering to the contacting portion 62. Referring to FIGS. 8-13, the only differences of the second embodiment comparing to the first one is that the conductive base 628 forms a plurality of slots 629 and the low conductive material 625 is molded over a conductive base 622 and fills in the slots 629.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

We claim:

1. An electrical connector comprising:

an insulative housing defining an opening for receiving a mating plug having a plurality of conductive terminals;

a plurality of electrical contacts disposed in said opening to slidably engage said conductive terminals of said mating plug, respectively;

wherein at least one of the electrical contacts has a conductive base and a low conductive material molding over a portion of the conductive base to form a conductive area and a less conductive area adjacent to said conductive area, when the plug is fully mated in the opening, the corresponding conductive terminal abutting the electrical contact on said conductive area, and when the plug is being withdrawn therefrom, the place where the electrical contact abuts the conductive terminal translates away from the conductive area to the less conductive area, and disengages the electrical contact therefrom;

wherein the conductive base is formed with a plurality of slots extending perpendicularly to the conductive area;

wherein the low conductive material encircles the conductive base and part of the low conductive material is disposed within the slots of said conductive base.

2. The electrical connector according to claim 1, wherein the less conductive material comprises a dielectrical material to form the less conductive area.

3. An electrical connector assembly comprising:

an electrical receptacle comprising a first insulative housing defining an opening and a plurality of electrical contacts secured in the first insulative housing;

an electrical plug being insertable into the opening and withdrawn therefrom, the electrical plug comprising a second insulative housing and a plurality of conductive terminals mounted in the second insulative housing;

wherein at least one of the electrical contacts forms an electrical contacting area and a dielectrical contacting area, wherein when the electrical plug is fully inserted into the opening of the electrical receptacle, corresponding number of the conductive terminals abuts the electrical contacting area of said at least one electrical contact, and when the electrical plug is being withdrawn therefrom, the conductive terminal translates from the electrical contacting area to the dielectrical contacting area and then disengages contact therefrom.

4. The electrical connector assembly according to claim 3, wherein the dielectrical contacting area is formed by a layer of a low conductive material coating over a conductive base and the electrical contacting area is formed of a top face of the conductive base neighboring on the dielectrical contacting area.

5. The electrical connector assembly according to claim 4, wherein the conductive base is formed with a plurality of slots extending perpendicularly from the top face and the low conductive material is molded over the conductive base, said low conductive material being disposed over a portion of the top face of the conductive base and within the slots of said conductive base.

6. The electrical connector assembly according to claim 5, wherein the low conductive material is integrally formed within a portion of the contact translation path of the conductive base.

7. An electrical connector assembly comprising:

an insulative housing; and a plurality of contacts disposed in the housing, each of said contacts defining a contacting region to which another contacting region of a counter contact of a complementary connector is coupled during mating; wherein said contacting region defines a first area which is coupled to the counterpart contact when fully mated, and a second area which is coupled to the counterpart contact at an early stage of mating and a final stage of un-mating, under a condition that the second area is less conductive than the first area so as to avoid arc during mating/un-mating; wherein the contacting region including the first area and the second area, extends in an oblique plane while said another contacting region is essentially a point-like region under a condition said point-like region of said counterpart contact moving along the oblique plane of contacting region, constantly mates either the first area or the second area during mating and defines a consistent conductivity thereof without variation.

8. The connector assembly as claimed in claim 7, wherein said second area is formed by a layer coated on the contact area.

9. The connector assembly as claimed in claim 7, wherein said second area is formed by an overmolded material.

* * * * *